US009858768B2

(12) United States Patent
Fong et al.

(10) Patent No.: US 9,858,768 B2
(45) Date of Patent: Jan. 2, 2018

(54) GAMING SYSTEM AND A METHOD OF GAMING

(75) Inventors: Colin Fong, Penshurst (AU); Peter Leslie Walker, Marsfield (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 914 days.

(21) Appl. No.: 13/467,711

(22) Filed: May 9, 2012
(Under 37 CFR 1.47)

(65) Prior Publication Data

US 2013/0072284 A1 Mar. 21, 2013

(30) Foreign Application Priority Data

May 13, 2011 (AU) ..... 2011901847

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01); *G07F 17/3223* (2013.01)

(58) Field of Classification Search
USPC ..... 463/20
See application file for complete search history.

(56) References Cited

U.S. PATENT DOCUMENTS 3,788,643 A 1/1974 Morrison et al.
6,113,492 A * 9/2000 Walker ..... G07F 17/32 273/138.2
6,159,098 A 12/2000 Slomiany et al.
6,224,483 B1 * 5/2001 Mayeroff ..... G07F 17/32 463/16
6,346,043 B1 2/2002 Colin et al.
6,416,409 B1 7/2002 Jordan
6,648,757 B1 11/2003 Slomiany et al.
6,769,986 B2 8/2004 Vancura
6,793,578 B2 9/2004 Luccesi et al.
6,932,340 B1 8/2005 Schaefer et al.
6,964,416 B2 11/2005 McClintic et al.
7,118,479 B2 10/2006 D'Amico et al.
7,166,028 B2 1/2007 Fasbender et al.
7,192,352 B2 3/2007 Walker et al.
7,278,919 B2 10/2007 Souza et al.
7,290,072 B2 10/2007 Quraishi et al.
7,316,613 B2 1/2008 Luccesi et al.
7,384,335 B2 6/2008 Boyd et al.
7,390,260 B2 6/2008 Englman
7,413,508 B2 8/2008 Nelson et al.
(Continued)

FOREIGN PATENT DOCUMENTS

JP 2002346224 12/2002
JP 2004097565 4/2004
(Continued)

*Primary Examiner* — Tramar Harper
(74) *Attorney, Agent, or Firm* — Armstrong Teasdale LLP

(57) ABSTRACT

Gaming systems, controllers, and associated methods are provided. An example gaming system includes a game controller arranged to control play of a game. The game includes a plurality of selectable game play characteristics. The game controller is arranged to control play of the game such that one or more of the selectable game play characteristics are played in the game.

31 Claims, 12 Drawing Sheets

(56) References Cited

U.S. PATENT DOCUMENTS

| | | | | |
|---|---|---|---|---|
| 7,597,621 | B2 | 10/2009 | Baerlocher | |
| 7,607,976 | B2 | 10/2009 | Baerlocher et al. | |
| 7,607,977 | B2 | 10/2009 | Baerlocher et al. | |
| 7,614,953 | B2 | 11/2009 | Souza et al. | |
| 7,621,809 | B2 | 11/2009 | Baerlocher et al. | |
| 7,624,986 | B2 | 12/2009 | Nicely | |
| 7,666,081 | B2 | 2/2010 | Baerlocher et al. | |
| 7,713,122 | B2 | 5/2010 | Pacey | |
| 2002/0167126 | A1 | 11/2002 | Herman De Raedt et al. | |
| 2002/0193162 | A1 | 12/2002 | Walker et al. | |
| 2003/0045323 | A1 | 3/2003 | Asada | |
| 2003/0054875 | A1* | 3/2003 | Marks et al. | 463/20 |
| 2003/0060281 | A1* | 3/2003 | Vancura | 463/30 |
| 2003/0083121 | A1* | 5/2003 | Cole | G07F 17/32 463/16 |
| 2003/0119580 | A1 | 6/2003 | McClintic et al. | |
| 2003/0176216 | A1 | 9/2003 | Storey | |
| 2003/0216165 | A1* | 11/2003 | Singer | G07F 17/34 463/20 |
| 2003/0220135 | A1 | 11/2003 | Gauselmann | |
| 2003/0224848 | A1 | 12/2003 | Baerlocher et al. | |
| 2004/0018874 | A1 | 1/2004 | Bonney et al. | |
| 2004/0043815 | A1 | 3/2004 | Kaminkow | |
| 2004/0152503 | A1 | 8/2004 | Lind et al. | |
| 2004/0219962 | A1 | 11/2004 | Vancura | |
| 2004/0242296 | A1 | 12/2004 | Nelson et al. | |
| 2004/0254009 | A1 | 12/2004 | D'Amico et al. | |
| 2004/0254014 | A1 | 12/2004 | Quraishi et al. | |
| 2005/0026679 | A1 | 2/2005 | Lucchesi et al. | |
| 2005/0043082 | A1* | 2/2005 | Peterson | G07F 17/3253 463/20 |
| 2005/0054419 | A1 | 3/2005 | Souza et al. | |
| 2005/0059475 | A1 | 3/2005 | Breen et al. | |
| 2005/0215316 | A1 | 9/2005 | Rowe et al. | |
| 2005/0245309 | A1 | 11/2005 | Englman | |
| 2005/0282626 | A1 | 12/2005 | Manfredi et al. | |
| 2006/0003832 | A1 | 1/2006 | Mincey et al. | |
| 2006/0040723 | A1 | 2/2006 | Baerlocher et al. | |
| 2006/0040732 | A1 | 2/2006 | Baerlocher et al. | |
| 2006/0040733 | A1 | 2/2006 | Baerlocher et al. | |
| 2006/0040734 | A1 | 2/2006 | Baerlocher et al. | |
| 2006/0040736 | A1 | 2/2006 | Baerlocher et al. | |
| 2006/0142077 | A1 | 6/2006 | Miles et al. | |
| 2006/0183531 | A1 | 8/2006 | Thomas | |
| 2006/0189379 | A1 | 8/2006 | Pacey | |
| 2006/0287046 | A1 | 12/2006 | Walker et al. | |
| 2006/0287060 | A1 | 12/2006 | Yoshimi | |
| 2007/0054733 | A1 | 3/2007 | Baerlocher et al. | |
| 2007/0060268 | A1 | 3/2007 | Nelson et al. | |
| 2007/0060269 | A1 | 3/2007 | Ruppert et al. | |
| 2007/0060376 | A1 | 3/2007 | Nelson et al. | |
| 2007/0105619 | A1 | 5/2007 | Kniesteadt et al. | |
| 2007/0106553 | A1 | 5/2007 | Jordan et al. | |
| 2007/0117618 | A1 | 5/2007 | Walker et al. | |
| 2007/0117619 | A1 | 5/2007 | Walker et al. | |
| 2007/0117620 | A1 | 5/2007 | Walker et al. | |
| 2007/0117621 | A1 | 5/2007 | Walker et al. | |
| 2007/0117622 | A1 | 5/2007 | Walker et al. | |
| 2007/0117641 | A1 | 5/2007 | Walker et al. | |
| 2007/0123347 | A1 | 5/2007 | Walker et al. | |
| 2007/0135206 | A1 | 6/2007 | Inamura | |
| 2008/0020847 | A1 | 1/2008 | Kniesteadt et al. | |
| 2008/0026832 | A1* | 1/2008 | Stevens | G07F 17/32 463/26 |
| 2008/0026840 | A1 | 1/2008 | Souza et al. | |
| 2008/0070676 | A1 | 3/2008 | Baerlocher et al. | |
| 2008/0070677 | A1 | 3/2008 | Baerlocher et al. | |
| 2008/0070678 | A1 | 3/2008 | Baerlocher et al. | |
| 2008/0081690 | A1 | 4/2008 | Baerlocher et al. | |
| 2008/0081691 | A1 | 4/2008 | Baerlocher et al. | |
| 2008/0102928 | A1 | 5/2008 | Daley | |
| 2008/0108431 | A1 | 5/2008 | Cuddy et al. | |
| 2008/0113771 | A1 | 5/2008 | Baerlocher et al. | |
| 2008/0139274 | A1 | 6/2008 | Baerlocher | |
| 2008/0139290 | A1 | 6/2008 | Kniesteadt et al. | |
| 2008/0153564 | A1 | 6/2008 | Baerlocher et al. | |
| 2008/0254857 | A1 | 10/2008 | Fujimoto et al. | |
| 2009/0075722 | A1* | 3/2009 | Louie | G07F 17/32 463/20 |
| 2009/0093298 | A1 | 4/2009 | Michel | |
| 2009/0093299 | A1 | 4/2009 | Acres | |
| 2009/0111565 | A1† | 4/2009 | Suda | |
| 2009/0124331 | A1* | 5/2009 | Delekta | 463/20 |
| 2009/0143136 | A1 | 6/2009 | Thomas | |
| 2009/0176552 | A1 | 7/2009 | Hornik et al. | |
| 2009/0186692 | A1 | 7/2009 | Thomas et al. | |
| 2009/0239618 | A1* | 9/2009 | Okada | 463/20 |
| 2009/0239641 | A1* | 9/2009 | Abe | 463/20 |
| 2009/0247271 | A1 | 10/2009 | Olive et al. | |
| 2009/0247289 | A1* | 10/2009 | Sugiyama et al. | 463/27 |
| 2009/0270173 | A1 | 10/2009 | Christensen | |
| 2009/0275392 | A1 | 11/2009 | Lewis | |
| 2009/0275411 | A1 | 11/2009 | Kisenwether et al. | |
| 2010/0004058 | A1 | 1/2010 | Acres | |
| 2010/0016062 | A1 | 1/2010 | Baerlocher | |
| 2010/0069149 | A1 | 3/2010 | Kisenwether et al. | |
| 2011/0014966 | A1* | 1/2011 | Yoshizawa | 463/20 |
| 2011/0117989 | A1* | 5/2011 | Kennedy | G07F 17/34 463/20 |

FOREIGN PATENT DOCUMENTS

| | | |
|---|---|---|
| JP | 2005300256 | 10/2005 |
| JP | P2006-333927 A † | 12/2006 |
| JP | 2008012018 | 1/2008 |
| JP | 2009100834 | 5/2009 |
| JP | 2009142557 | 7/2009 |
| WO | 03020386 | 3/2003 |
| WO | 2004111960 | 12/2004 |
| WO | 2005029287 | 3/2005 |
| WO | 2005089374 | 9/2005 |
| WO | 2006012429 | 2/2006 |
| WO | 2006023401 | 3/2006 |
| WO | 2007123710 | 11/2007 |
| WO | 2007127259 | 11/2007 |
| WO | 2007139874 | 12/2007 |
| WO | 2007139988 | 12/2007 |
| WO | 2008154433 | 12/2008 |
| WO | 2009120310 | 10/2009 |
| WO | 2009134813 | 11/2009 |

* cited by examiner
† cited by third party

GAMING SYSTEM AND A METHOD OF GAMING

CROSS-REFERENCE TO RELATED APPLICATIONS

This patent arises from and claims the benefit of priority to Australian Provisional Patent Application No. 2011901847, filed on May 13, 2011, entitled "Gaming System and A Method of Gaming", which is herein incorporated by reference in its entireties.

FIELD

The present invention relates to a gaming system and a method of gaming, and more particularly, but not exclusively, to a gaming system wherein a base game is played which generates as one of its outcomes a feature game.

BACKGROUND

It is known to provide a gaming system which comprises a game controller arranged to control the random display of several symbols from a pre-determined set of symbols and to determine a game outcome such as a game win, based on the displayed symbols. Such gaming systems may commonly be implemented as a stepper machine provided with reels, with each reel carrying several symbols of the set, or a video machine wherein selected symbols are displayed on virtual reels on a graphical display device. Win outcomes can occur based on symbols appearing on one or more horizontal lines, diagonal lines, or in any other predetermined way.

A player of such gaming systems may wager credit on game results and receive credit when a game win occurs.

It is known to provide gaming systems where a game controller controls play of a base game (which may determine a game outcome based on selection from a predetermined set of symbols) and a feature game. A feature game may be generated as one of the game outcomes of the base game. For example, a feature game may comprise one or more "free games" triggered by a predetermined combination of symbols occurring as a result of play of a base game, a trigger based on a random number being generated, or any other trigger.

Feature games provide additional interest and attraction to players.

While current gaming systems which provide base games and feature games provide users with enjoyment, the need exists for alternative gaming systems in order to maintain and increase player enjoyment.

BRIEF SUMMARY

In accordance with a first aspect, certain embodiments provide a gaming system, including a game controller arranged to control play of a game, the game including a plurality of selectable game play characteristics, the game controller being arranged to control play of the game such that one or more of the selectable game play characteristics are played in the game.

In an embodiment, the game controller is arranged to control operation of a characteristic selection game, an outcome of the characteristic selection game being which of the selectable game play characteristics will be played in the game.

An advantage of at least one embodiment is that having a plurality of game characteristics which can be selected from provides additional interest for players of the game. Further, it can provide additional opportunities for prizes to the players.

In an embodiment, two or more or all of the selectable characteristics can be played together in the game, if selected. In an embodiment, the game play characteristics may provide game play rules and the rules can be overlayed to be played together.

In an embodiment, the game is a wagering game and game wins may result in wins of credit for a player. In an embodiment, one or more of the selectable game play characteristics may include game play rules which affect the chance of player wins, or increase the quantum of a player win if a win occurs.

An advantage of the embodiment where a characteristic selection game is played to select which game play characteristics will be played, is that the characteristic selection game may provide additional interest for players. In an embodiment, the gaming system includes a display, and the characteristic selection game is viewable by a player via the display. In an embodiment, the game controller is arranged to implement the characteristic selection game by randomly selecting and displaying several symbols from a predetermined set of symbols, and to determine an outcome, being which of one or more game play characteristics are to be played.

In an embodiment, the gaming system includes a first display arranged to display the selected symbols, and a second display associated with the first display. In an embodiment, the second display includes a plurality of feature symbols which are associated with selection of In an embodiment, during the characteristic selection game, one or more of the feature symbols from the second display appears in the first display. In an embodiment, the feature symbols are used in the first display to determine characteristic selection. In an embodiment, the second display is positioned as a framework about the first display.

In the embodiment where the characteristic selection game includes selecting a plurality of symbols from a predetermined set of symbols, in an embodiment the first display includes a plurality of rows and columns arranged to present the symbols in row and column format. In an embodiment, the symbol format is a reel format, where the game controller is arranged to randomly select and display several symbols from a pre-determined set of symbols and to select the game play characteristics based on the selected symbols. The display may include a virtual reel display, or actual reels controlled by a stepper machine.

In an embodiment the row and column display has an aspect ratio including a greater number of rows to columns (e.g., a "portrait" aspect ratio). In an embodiment there are between three to six columns and between five to ten rows. In an embodiment, there are four columns and six rows.

In an embodiment, the game is played as a feature game. The game controller is arranged to control operation of a base game, and the feature game is played in addition to the base game. In an embodiment, the base game also includes a game in which the game controller is arranged to select a plurality of symbols from a set of symbols and to determine a game outcome such as a game win based on the selected symbols. In an embodiment, the base game is also a reel-type game. In an embodiment, the base game is also played via the first display, as with the characteristic selection game. In an embodiment, the feature game is also played on the first display, as reel-type games.

In an embodiment, the characteristic selection game may be triggered as a result of play of the base game or during play of the base game. In an embodiment the trigger may be one or more predetermined symbol selections which may be an outcome of the base game. In an alternative embodiment, the trigger may be a random trigger, such as a random number generated by a random number generator. The characteristic selection game may be triggered in any other way.

In accordance with a second aspect, certain embodiments provide a method of gaming, including controlling operation of a game, the game including a plurality of selectable game play characteristics, the controlling operation of the game being arranged to control play of the game such that one or more of the selectable game play characteristics are played in the game.

In accordance with a third aspect, certain embodiments provide a computer program, including instructions for controlling a computer to implement a gaming system in accordance with the first aspect.

In accordance with a fourth aspect, certain embodiments provide a computer readable medium, providing a computer program in accordance with the third aspect.

In accordance with a fifth aspect, certain embodiments provide a data signal, including a computer program in accordance with the third aspect.

In one embodiment, the gaming system and method provide multiple levels of gaming In one embodiment, there are three levels of gaming: the first level (e.g., a base game in the form of a symbol selection game), which may lead to a second level of gaming (the characteristic selection game, which may be a symbol selection game), which may lead to a third level of gaming (the feature game with one or more of the game play characteristics to be played together, which may be a symbol selection game). Such multiple level gaming has the advantage of maintaining player interest and entertainment.

In accordance with a sixth aspect, certain embodiments provide a gaming system, including a game controller arranged to control operation of a base game having a plurality of available game outcomes, to control operation of a characteristic selection game, having a plurality of available game outcomes resulting in selection of game play characteristics to play in a feature game, and being arranged to control operation of one or more the feature game to be played with the selected game play characteristics.

In an embodiment, the base game, characteristic selection game and feature game are all games where the game controller is arranged to determine game outcomes on the basis of selection of symbols from a predetermined set of symbols. In an embodiment, each of the base game, feature selection game and feature game, are reel-type games. In an embodiment, they are all played on the same display.

In accordance with a seventh aspect, certain embodiments provide a method of gaming, including playing a base game having a plurality of available game outcomes, playing a characteristic selection game for selecting game play characteristics to play in a feature game, and playing feature game with the selected game play characteristics.

In accordance with an eighth aspect, certain embodiments provide a computer program, including instructions for controlling a computer to implement a gaming system in accordance with the sixth aspect.

In accordance with a ninth aspect, certain embodiments provide a computer readable medium, providing a computer program in accordance with the eighth aspect.

In accordance with a tenth aspect, certain embodiments provide a data signal, including a computer program in accordance with the eighth aspect.

In accordance with an eleventh aspect, certain embodiments provide a gaming system, including a game controller arranged to control play of a game, the game including a plurality of selectable game play characteristics, the game controller being arranged to control play of a characteristic selection game, an outcome of the characteristic selection game being which of the selectable game play characteristics will be played in the game, the game controller being arranged to control play of the game with the selected game play characteristic.

In accordance with a twelfth aspect, certain embodiments provide a method of gaming, including controlling operation of a game, the game including a plurality of selectable game play characteristics, the method including the further step of controlling operation of a characteristic selection game to select a game play characteristic to be played in the game, and controlling operation of the game to play the game with the selected game play characteristic.

In accordance with a thirteenth aspect, certain embodiments provide a computer program, including instructions for controlling a computer to implement a gaming system in accordance with the eleventh aspect.

In accordance with a fourteenth aspect, certain embodiments provide a computer readable medium, providing a computer program in accordance with the thirteenth aspect.

In accordance with a fifteenth aspect, certain embodiments provide a data signal, including a computer program in accordance with the thirteenth aspect.

BRIEF DESCRIPTION OF DRAWINGS

Features and advantages of the present invention will become apparent from the following description of embodiments thereof, by way of example only, with reference to the accompanying drawings, in which.

Figure 1:
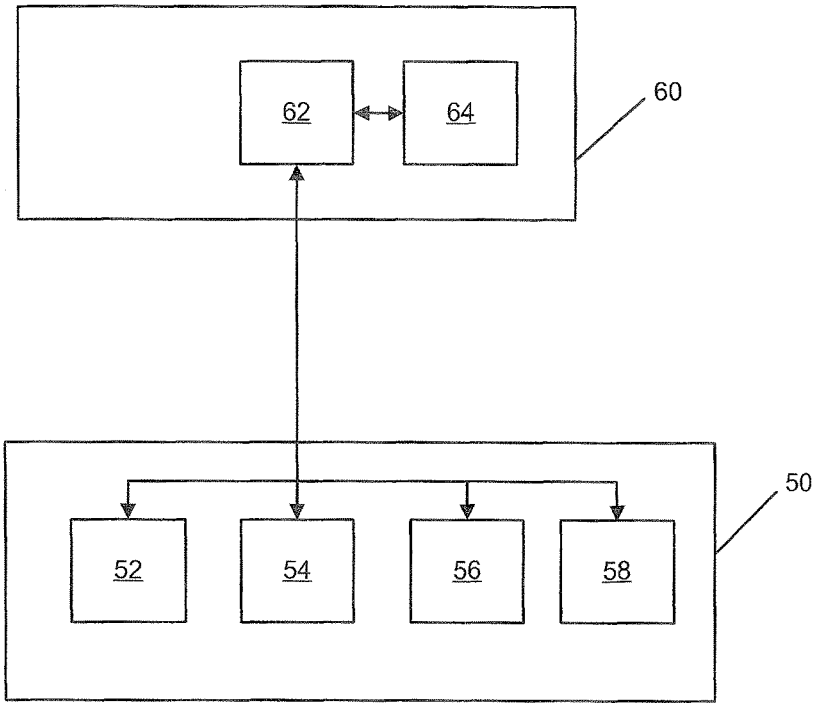
FIG. 1 is a block diagram of the core components of a gaming system.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Although the following discloses example methods, systems, articles of manufacture, and apparatus including, among other components, software executed on hardware, it should be noted that such methods and apparatus are merely illustrative and should not be considered as limiting. For example, it is contemplated that any or all of these hardware and software components could be embodied exclusively in hardware, exclusively in software, exclusively in firmware, or in any combination of hardware, software, and/or firmware. Accordingly, while the following describes example methods, systems, articles of manufacture, and apparatus, the examples provided are not the only way to implement such methods, systems, articles of manufacture, and apparatus.

When any of the appended claims are read to cover a purely software and/or firmware implementation, at least one of the elements in an at least one example is hereby expressly defined to include a tangible medium such as a memory, DVD, CD, Blu-ray, etc., storing the software and/or firmware.

Figure 7:
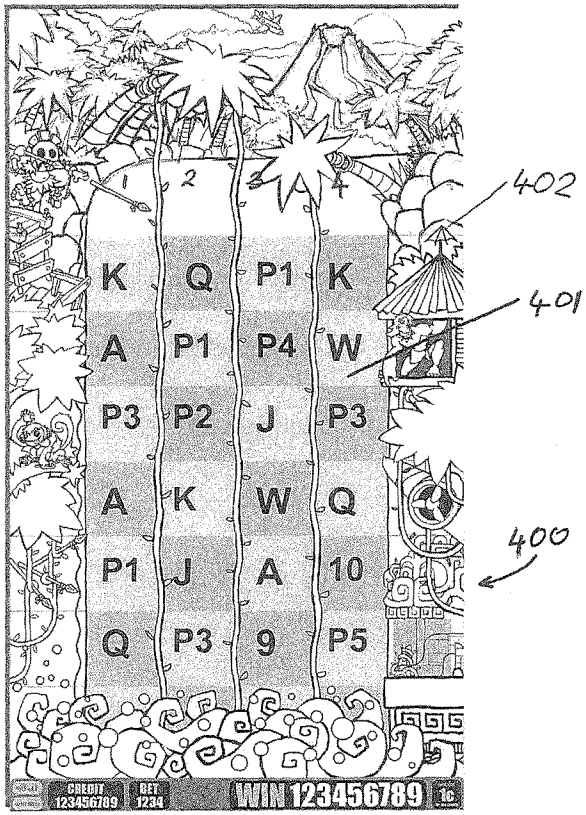
FIG. 7 is a representation of a display of a gaming system, illustrating play of a base game.

Referring to the drawings, there is illustrated an example embodiment of a gaming system which is arranged to implement a game. The gaming system includes a game controller arranged to control operation of a game which includes a plurality of selectable game characteristics. In this example embodiment, the game is played as a feature game played in addition to a base game. The base game and feature game are reel-type games. An example of a display of the gaming system is illustrated in FIG. 7. The display 400 includes a reel-type display 401 arranged to play a base game. The game controller determines game outcomes on the basis of selection of a plurality of symbols from a set of predetermined symbols.

Figure 11:
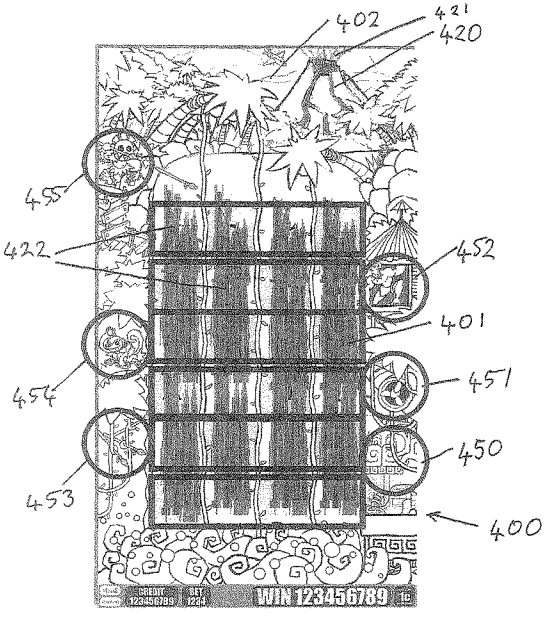
FIG. 11 is a representation of the display of the gaming system of the embodiment of FIG. 7, illustrating triggering of a characteristic selection game.

In this embodiment, the game controller is arranged to control operation of a plurality of selectable game play characteristics for the feature game. Which of the game play characteristics are played is determined by a characteristic selection game which is played in addition to the base game. Referring to FIG. 11, in this embodiment six game play characteristics are available and the characteristic selection game is a reel-type game based on the selection of feature symbols 450, 451, 452, 453, 454, 455, playing on lines 460 to 466 of the reel-type display. Depending on the selection of the feature symbols 451 to 455, in this embodiment the game controller controls operation of the feature game so that one or more of the game play characteristics is played in the feature game. Two or more or all of the selectable game play characteristics may be played at the same time in this embodiment.

The gaming system can take a number of different forms. In a first form, a stand alone gaming machine is provided wherein all or most components to implement the game are present in a player operable gaming machine.

In a second form, a distributed architecture is provided wherein some of the components to implement the game are present in a player operable gaming machine and some of the components to implement the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is, a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
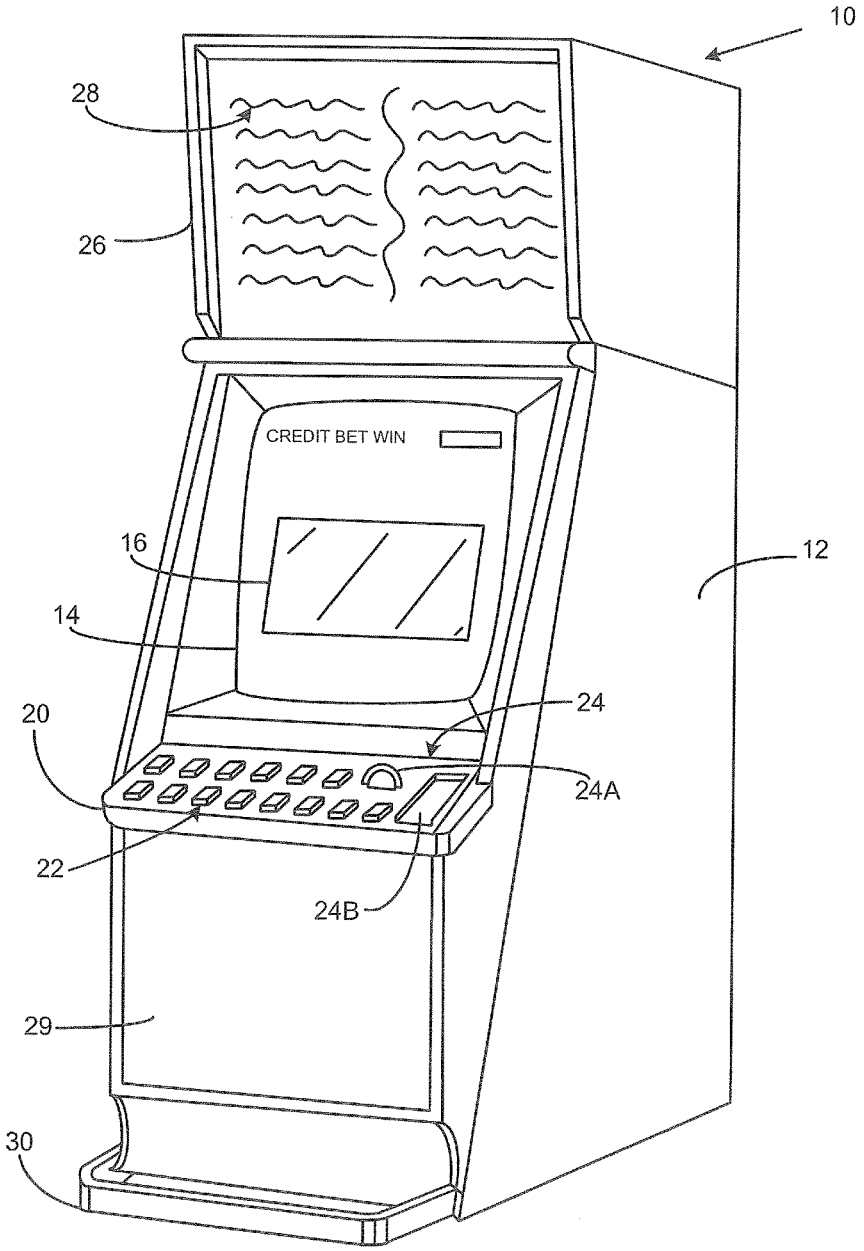
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may be configured for tickets in such that they have a ticket reader for reading tickets having a value and crediting the player based on the face value of the ticket. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
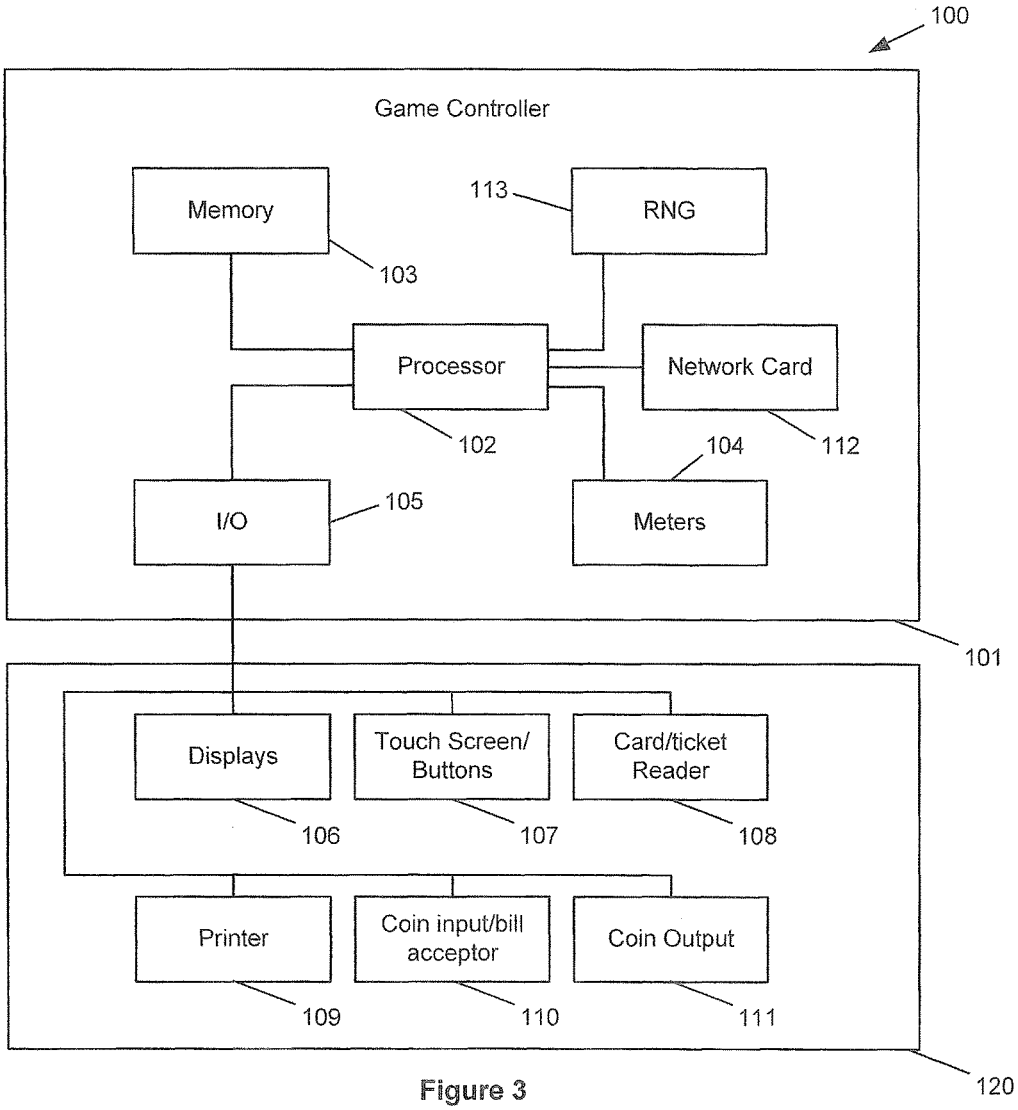
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted based on the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
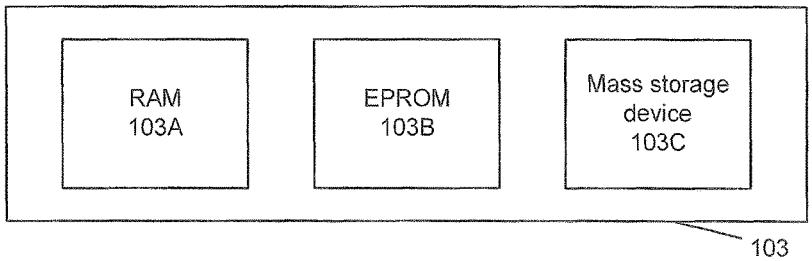
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
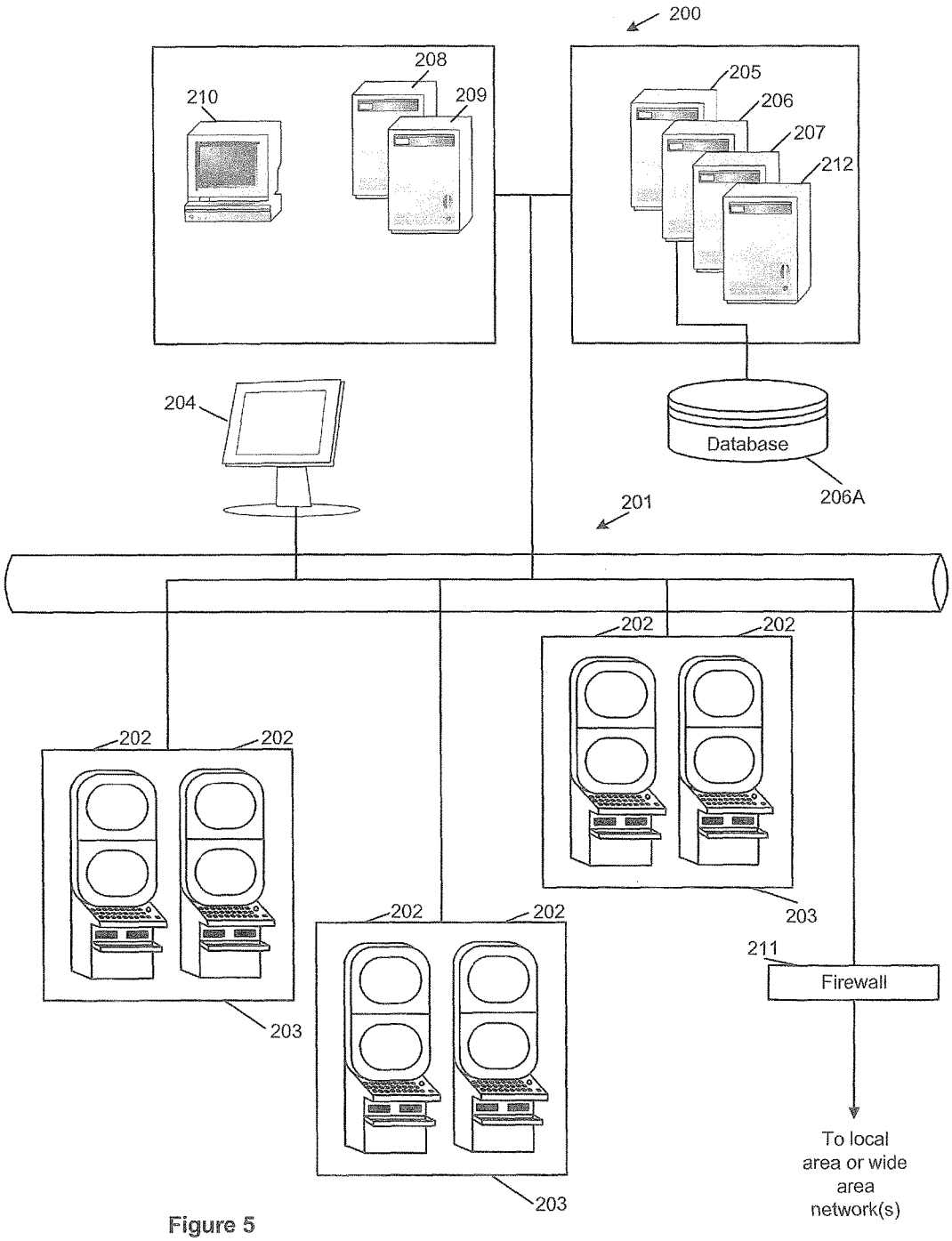
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the rules, guidelines, preferences, and/or requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g., PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games based on the terminals.

Figure 6:
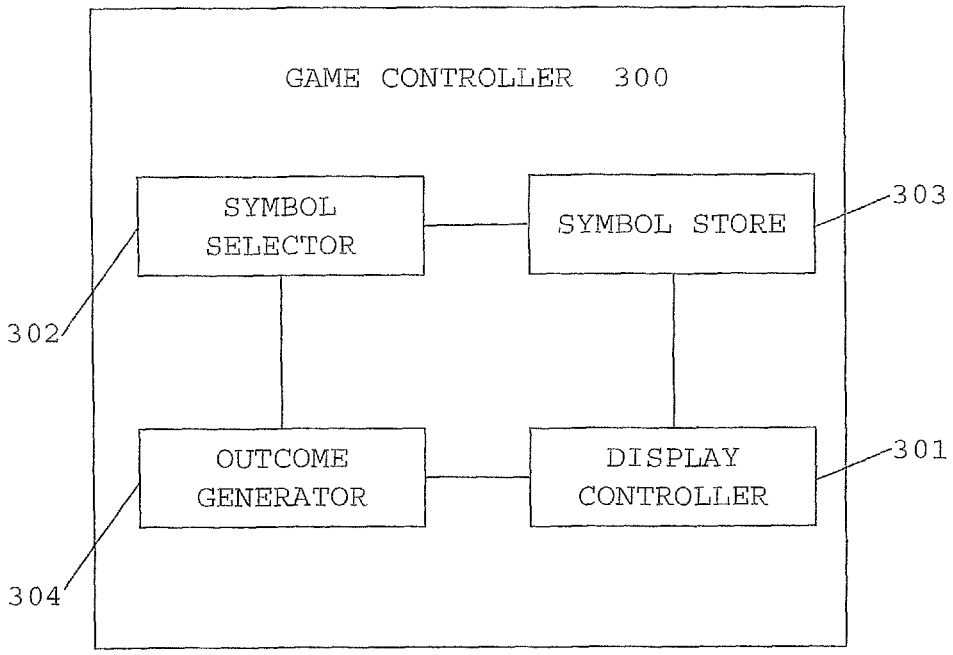
FIG. 6 is a schematic diagram of functional components of a gaming system.

Referring to FIG. 6, the functionality of embodiments of the present invention may be implemented by a game controller having the functional components illustrated. In this embodiment, the functional components are implemented utilising a processor and memory, (such as processor 102 and memory 103 in FIG. 3, or processor 62 and memory 64 in FIG. 1, or the game server 205 in FIG. 5) and associated programming. Other implementations are envisaged. For example the functional blocks of FIG. 6 may be implemented in hardware as separate units, or a combination of hardware and software as separate units. Any practical implementation of these functional units may be employed.

In this embodiment, the game controller 300 is arranged to control the gaming system to play a base game which includes selection of a plurality of symbols from a set of symbols. The base game is implemented as a "reel" game. The game controller 300 includes a display controller 301 which is arranged to control the display (reference numerals 54, 14, 106, 204 of previous figures) to emulate a representation of reels bearing symbols. Alternatively, the display may include a stepper motor and physical reels bearing the symbols.

The game controller 300 includes a symbol selector 302 which is arranged to select a plurality of symbols from a set of symbols available in a symbol store 303. An outcome generator 304 is arranged to determine an outcome of the base game. In this embodiment, the outcome of the base game depends on the selected symbols and may include a win outcome, loss outcome or other outcome. Outcomes may be determined on the basis of symbols appearing in one or more horizontal lines, diagonal lines, or any other predetermined combinations.

FIG. 7 shows a schematic representation of a gaming machine display 400 (which may be generated by any type of displays such as 54, 14, 106, 204 of the embodiments of previous figures) which, in the example shown includes a reel type display 401, having four reels (numbered "1" to "4"). The reel display 401 shows six reel positions when the reels have stopped/the symbols have been selected. This is a novel type reel display, having four reels and six reel positions. It is a "portrait" display, where the aspect ratio of the display has more rows than columns. It will be appreciated that the number of rows and columns may vary from six and four, and for example, may be between three to six columns and five to ten rows.

The reels may be virtual reels, generated as a video display from the selected symbols, actual mechanical reels carrying the symbols and driven by a stepper motor, or any other reel arrangement or emulation. In the case of actual physical reels, the game controller drives a stepper motor to randomly select the symbols appearing in the display 401.

The game outcome is determined by the outcome generator 304 based on combinations of symbols selected and appearing in the display 401. The symbols may be any symbols. As will be appreciated, many different types of symbols are used in gaming systems. A set of symbols may include standard symbols and function symbols. For example, standard symbols may resemble fruit such as apples, pears and bananas with a win outcome being determined when a predetermined number of the same fruit appear on a display in the same line, scattered, and so on. The function associated with a function symbol may be a "wild" function wherein display of the function symbol is treated during consideration of the game outcome as any of the standard symbols. Other functions may include scatter functions, multiplier functions, repeat win functions, jackpot functions and feature commencement functions.

In the example shown in FIG. 7, the symbols are representations of cards, by which a poker-type card game may be played. In this example, a winning poker hand appearing on the 9 line may cause the outcome generator to determine that a Win has occurred and that an appropriate prize may be awarded. For example, four of a kind (e.g. 4 jacks "J", 4 tens "10" etc on a line may result in a win). A straight or a straight flush or any other poker combination on a line may also result in a win.

In addition to card symbols, the symbols also include a Wild "W" symbol which is a function symbol which, when it occurs on a line may be considered by the outcome generator 304 to operate as any symbol which may assist in a win. Symbols may also include a Jackpot ("JP") symbol which when four JP symbols appear on a line may result in a jackpot win. The jackpot may be a progressive jackpot, a linked progressive jackpot, or any other type of jackpot.

The diagram shown in FIG. 7 is schematic only and it will be appreciated that embodiments of the invention may implement the symbols graphically, with fancy artwork or in any other appropriate manner.

A game outcome may include a win entitlement which may result in a prize being awarded to a player.

Persons skilled in the art will appreciate that a player's win entitlement will vary from game to game and may or may not be dependent on player selections. In most spinning reel games, it is typical for the player's entitlement to be affected by the amount they wager and selections they make (i.e. the nature of the wager). For example, a player's win entitlement may be based on how many lines they will play in each game—i.e. a minimum of one line up to the maximum number of lines allowed by the game (noting that not all permutations of win lines may be available for selection). Such win lines are typically formed by a combination of displayed symbol positions, one from each reel, the symbol positions being located relative to one another such that they form a line.

In many games, the player's win entitlement is not strictly limited to the lines they have selected. For example, "scatter" pays may be awarded independently of a player's selection of pay lines and may be an inherent part of the win entitlement.

Persons skilled in the art, will appreciate that in other embodiments, the player may obtain a win entitlement by selecting a number of reels to play. Such games are marketed under the trade name "Reel Power" by Aristocrat Leisure Industries Pty Ltd. The selection of the reel means that each symbol of the reel can be substituted for a symbol at one or more designated display positions. In other words, all symbol positions of a selected reel can be used to form symbol combinations with designated, display symbol positions of other reels.

In other embodiments a player win entitlement may be affected by purchasing access to particular pay tables—e.g. a first bet amount entitles the player to wins including cherries and a second amount entitles them to wins including plums. The win entitlement is not always purchased—e.g. a series of free games may be awarded.

Figure 8:
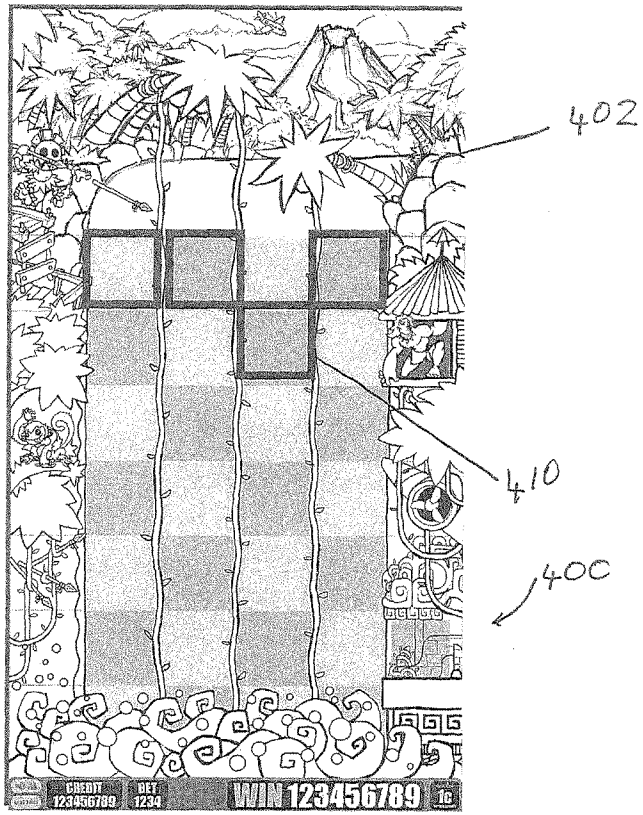
FIGS. 8 to 10 are representations of the display of FIG. 7, illustrating how win lines may be assessed in a game.
Figure 10:
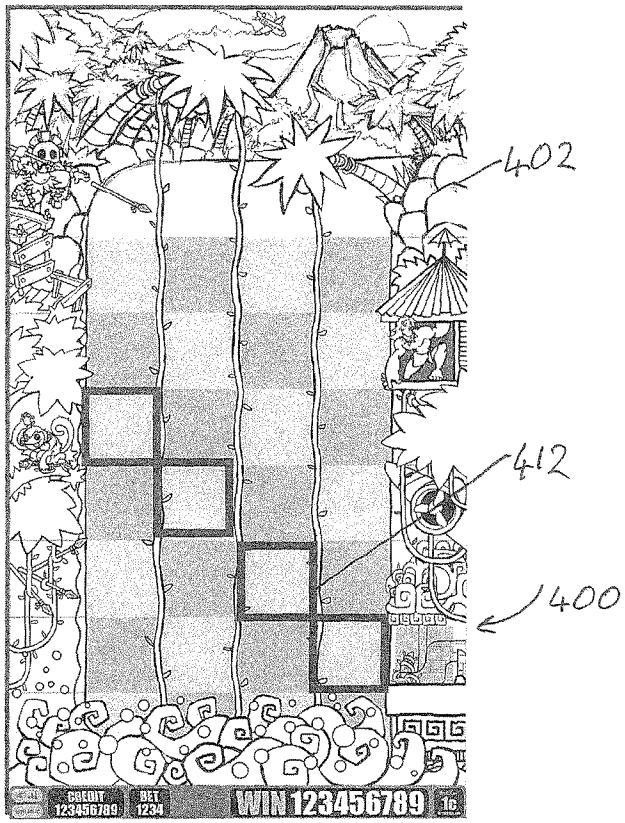
Figure 9:
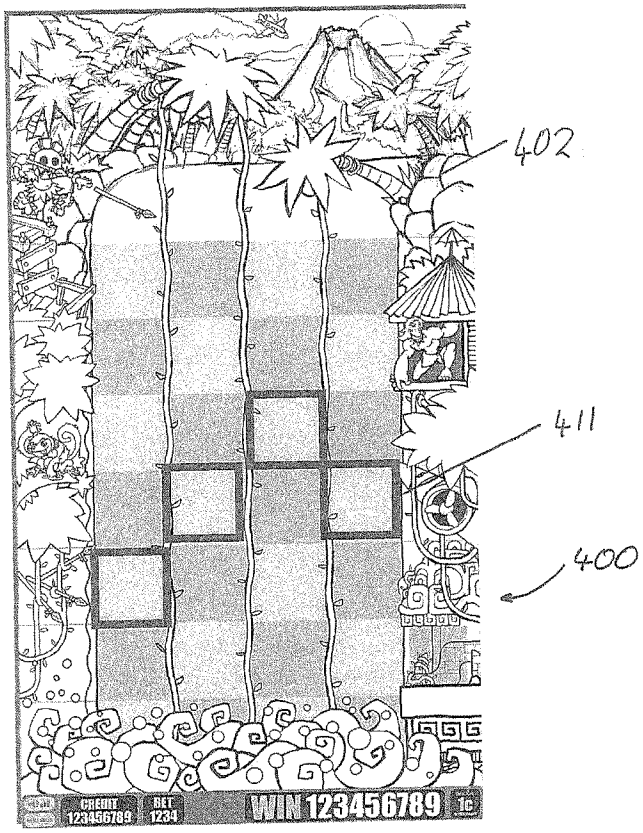

In this embodiment of the invention, the portrait nature of the display enables a number of win lines to be implemented. In this particular embodiment, 122 win lines are implemented. FIGS. 8 through 10 illustrate various win lines. Game rules are applied, in view of the aspect ratio of the display, to limit adjacent line paths to move up or down one row at a time. Further, win lines are only allowed to pass through a maximum of four rows.

FIG. 8 shows one win line 410. The line path moves down in the third column one row, and back up to the top row in the next column.

FIG. 9 shows another win line 411. This includes a diagonally upward line path for the first three columns and then one diagonal down for the next column.

FIG. 10 shows a diagonal line 412 downwards from left to right.

Lines pass through a maximum of four rows and from left to right.

Lines may also be horizontal (e.g., straight across a row).

The invention is not limited to this type of line path for games. Other line paths may be implemented in alternative embodiments depending on game rules.

As well as playing a base game, this embodiment of the invention is also arranged to generate a feature game. Further, a characteristic selection game is played to determine which of a plurality of selectable game play characteristics will be played in the feature game. The characteristic selection game is triggered from the base game, in this embodiment, by a random trigger. A random trigger in this embodiment is a random number selected by a random number generator in the gaming system, coinciding with one or more predetermined numbers which result in a feature trigger.

A range or group of numbers may be preselected. If the random number generated falls within the range or group, the feature trigger occurs.

Alternatively, the feature trigger may be symbol driven. That is, the feature trigger could occur as an outcome of a base game, depending on predetermined symbols being selected.

The feature trigger may be generated in any other way.

The display 400, as well as including the reel display 401, also includes a second display 402 formed as a frame about the first display 401 and including graphics which may include animated symbols.

Referring to FIG. 11, when the feature trigger occurs, a "volcano" graphic 420 in the second display "erupts" (shown as an animated representation 421 on display 402, and on display 401 a representation of flowing lava 422 appears in place of the reels). This indicates commencement of the characteristic selection game.

The second display 402 includes representation of symbols 450, 451, 452, 453, 454, 455 which are associated with a "jungle" theme in this particular embodiment. During play of the characteristic selection game, each of these symbols may appear in the reel display 401, to determine the outcome of the characteristic selection game. Four "jungle man" symbols 452 appearing in the row adjacent to the "jungle man" symbol 452 in the frame display 402, will result in a game play characteristic associated with that symbol 452 being subsequently played in the feature game. Similarly for game play characteristics which are associated with the other feature symbols 450, 451, 453, 454 and 455. For a game play characteristic to be selected in this embodiment, four of the associated feature symbols need to appear in a horizontal row in the reel display 401.

Figure 12:
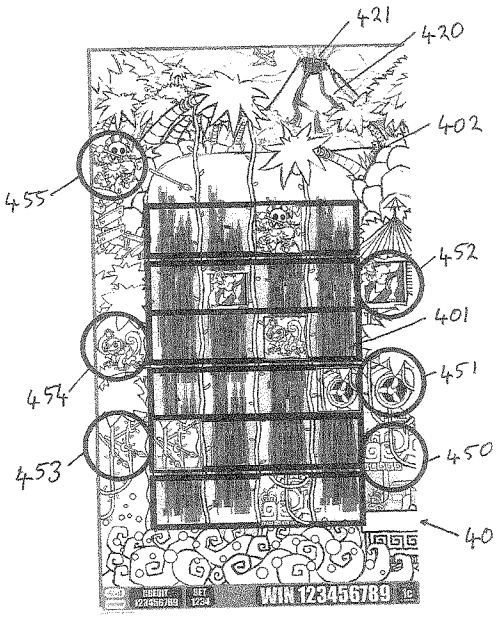
FIGS. 12 through 15 are representations of display of the gaming system of the embodiment of FIG. 7, illustrating characteristic selection game play.
Figure 14:
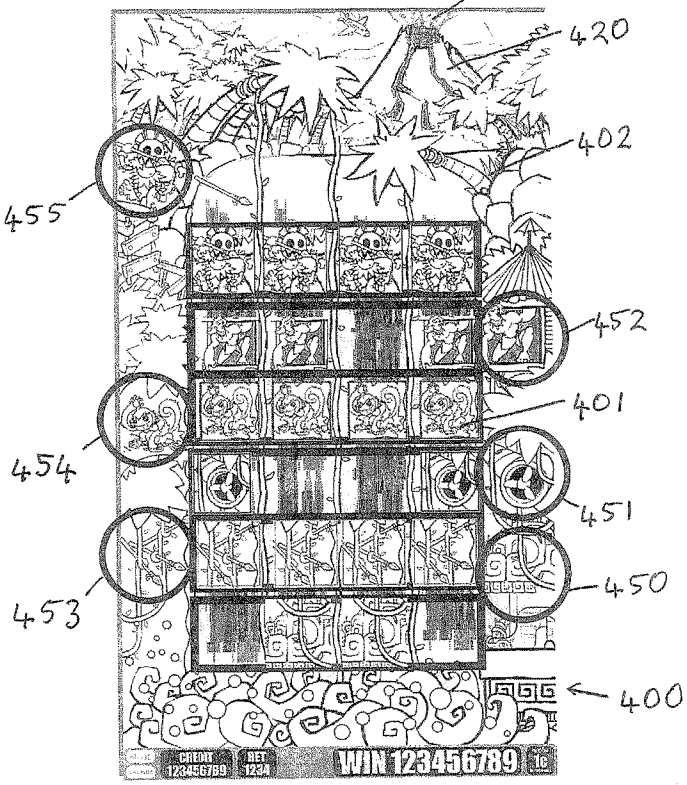
Figure 13:
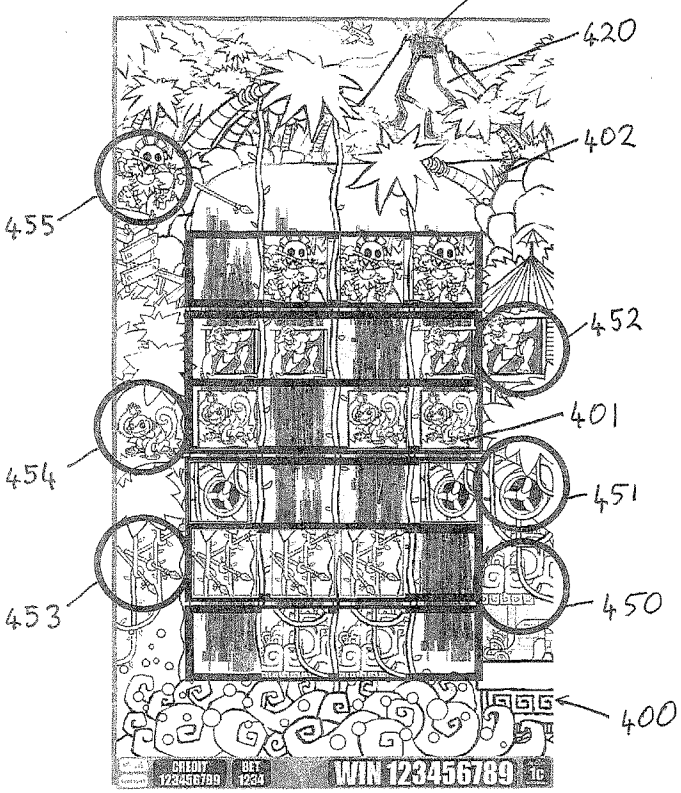
Figure 15:
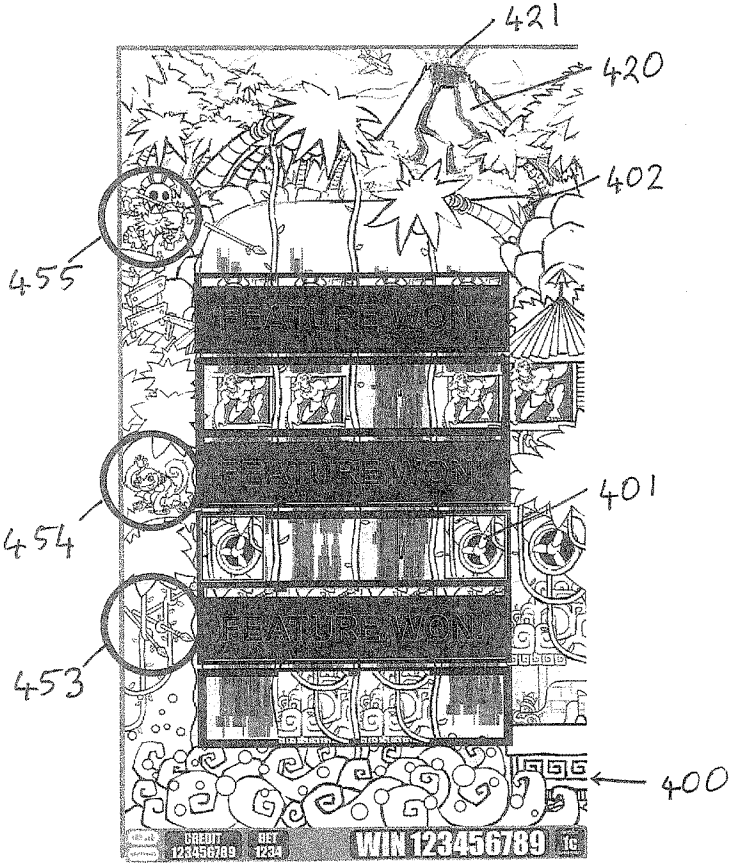

During the play of the characteristic selection game, a random selection is made of the feature symbols to appear in the rows and if four feature symbols appear in one row, then that game play characteristic will be used in the subsequently played feature game. FIGS. 12, 13 and 14 illustrate play of a characteristic selection game, with feature symbols appearing in the display as the reels come to a halt. Referring to FIG. 14, the first, third and fifth row show four of their associated feature symbols in line. Three game play characteristics are selected for play, therefore. Game play characteristic selection is illustrated in FIG. 15 where the display shows "FEATURE WON!" in each of the winning rows. The three selected game play characteristics will then form part of the subsequently played feature game.

Advantageously, the characteristic selection game adds to the player's interest. Having more than one game play characteristic which can be played concurrently in the feature game, is a further attraction for players.

The interaction of the animated graphical symbols in the second display 402, with the reel display 401, also provides an attraction. In this embodiment, the feature symbols 450 to 455 become animated when the characteristic selection game is taking place.

It will be appreciated that the characteristic selection game is not limited to the particular feature symbols and display themes shown in the drawings, i.e. a jungle theme. Any symbols may be used as feature symbols and represented by graphics in the second display 402. For example, there could be a casino theme, a football theme, or any other theme.

In this embodiment, the feature games include a series of five "free" games. The free games are in the form of reel games which have win outcomes, loss outcomes or any other outcomes based on symbol selection. Feature game outcomes are determined based on predetermined symbols being selected. That is, a win outcome will depend upon predetermined symbols being selected on a line, scatter or otherwise. Feature game outcomes may be determined in other ways.

In this embodiment, five free games are played sequentially. It will be appreciated that the invention is not limited to five free games, and any number of free games may be played. More or less free games may be played. In other embodiments the feature game format may be different.

Depending on the selectable game play characteristics won, each free game is associated with a game rule which may affect the outcome of the game. For example, one game play characteristic may be a "multiplier". Any game win is multiplied by "×" times if the "multiplier" characteristic is won in the characteristic selection game. In this embodiment, the game play characteristics include the following:

1. Sticky Wild (Monkey Symbol 454) Feature. Any wilds that appear are held in that position for any remaining free games.
2. Bonus Prize (Jungle Man Symbol 452) Feature. At the end of each free game, the player is prompted to "Pick a Vine". The Jungle man swings to that vine as represented by graphics in display 402 and a credit prize is revealed that is awarded to the player.
3. Collect Wild (Spear Symbol 453) Feature. The number of wilds that appear during free games are tallied and randomly allocated to windows for an extra bonus spin.
4. Drag 'n Drop Multiplier (Propeller Symbol 451) Feature. At the beginning of the free games the player is prompted to "drag 'n drop" the propeller symbol to any position on the reels, where it remains for the duration of the free games. Any win passing through this selected position is multiplied by up to ×50. In this embodiment screen 402 and screen 401 are touch screens, which enable the player to touch the propeller symbol and drag it across to the reels. This has the advantage of giving the player some further involvement with the game.
5. All Wins Multiplier (Witch Doctor Symbol 455) Feature. All wins during the free games are multiplied by up to ×10.
6. Diminishing Royals (Statue Symbol 450) Feature. After each free game a royal symbol (Ace, King, Queen or Jack) is randomly selected and removed from all reels for any remaining free games.

The invention is not limited to selectable game play characteristics being the six feature game rules discussed above. Any other game rules could be implemented in addition or alternatively to the above feature game rules. In this embodiment, if two or more game play characteristics are selected to be played, then they are played concurrently. For example, rules 2, 3 and 4 could be selected to play concurrently, which would result in five free games, each game including a Bonus Prize Feature, the Collect Wild Feature, and the Drag and Drop Multiplier Feature. This adds to user entertainment. Any one or more of the game play characteristics may be selected to run concurrently, depending upon the outcome of the characteristic selection game.

Figure 16:
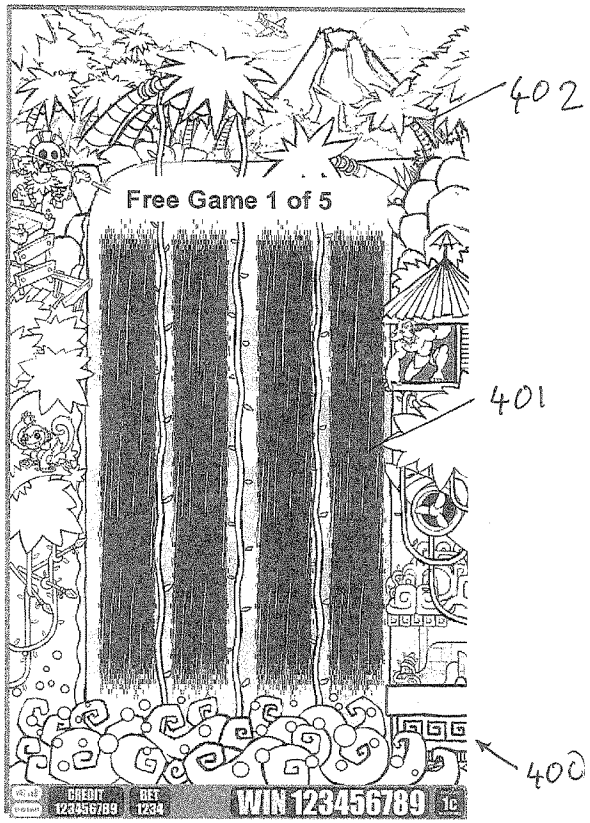
FIGS. 16 and 17 are example displays of the gaming system of the embodiment of FIG. 7, illustrating feature game play.
Figure 17:
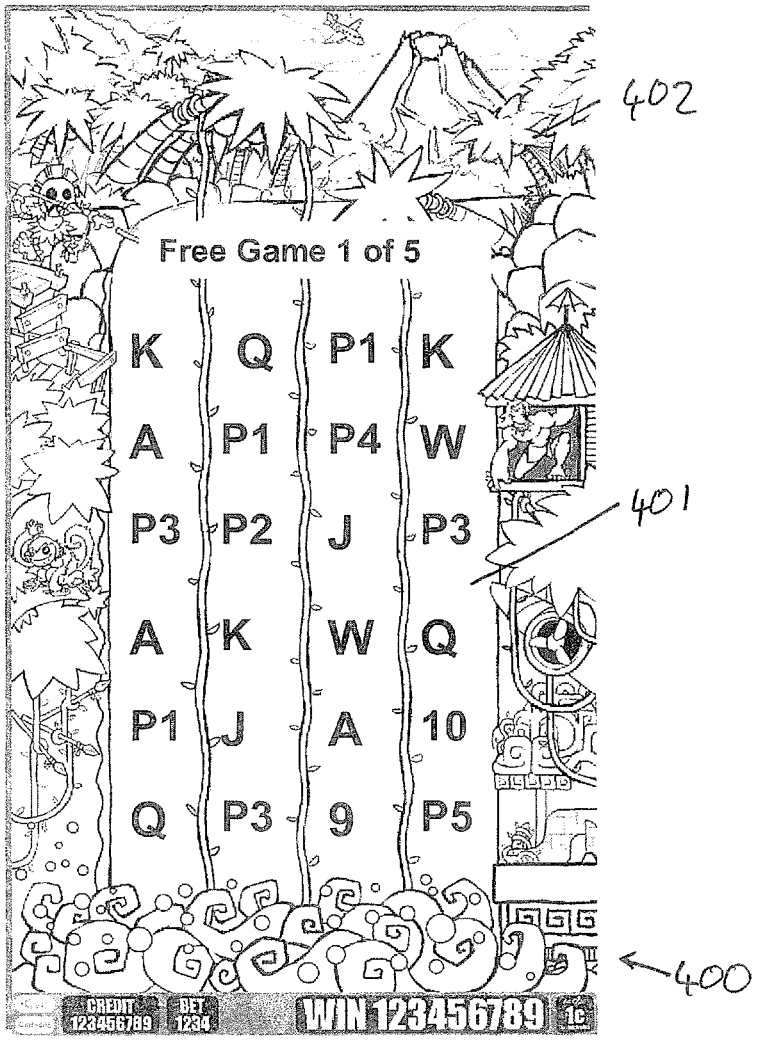

Referring to FIGS. 16 and 17, a series of five free games are played, incorporating game rules that have been selected during the characteristic selection process. In this embodiment, conventional symbols are used in the feature game, as in the base game.

After the feature games have been completed, the gaming system returns to base game play.

Having two or more game play characteristics selected, can result in greater payouts and more excitement for the player. It may be that more than two characteristics are selected rarely and three, four, five or six characteristics selected very rarely, in order to ensure that the game machine wins are appropriately regulated. Feature game play, for example could be associated with large jackpots when multiple game play characteristics are selected to play concurrently.

Figure 18:
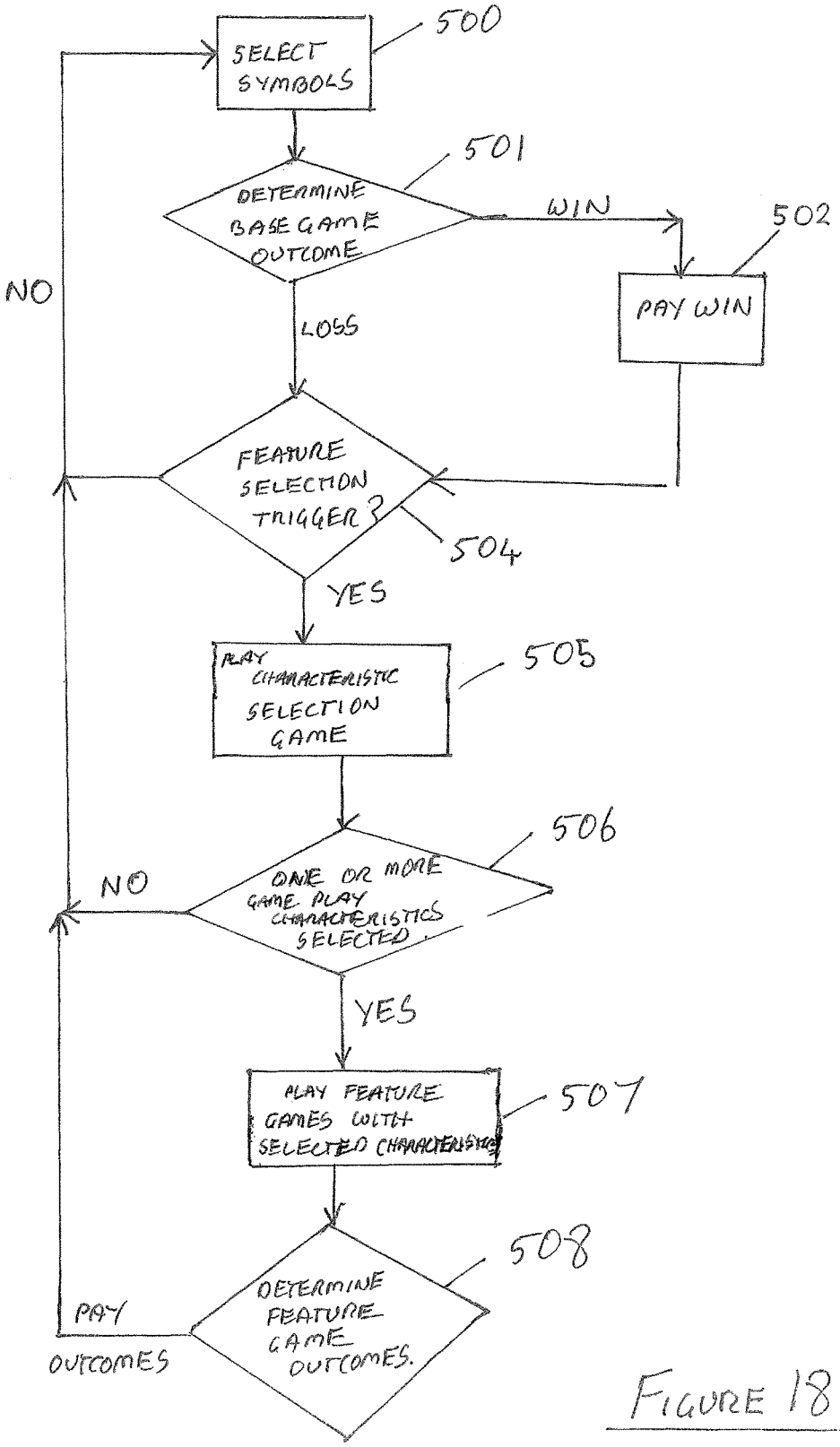
FIG. 18 is a flow diagram illustrating operation of a gaming system in accordance with the embodiment of FIGS. 7 to 15.

An example method is illustrated in the flowchart of FIG. 18. FIG. 18 depicts an example flow diagram representative of processes that may be implemented using, for example, computer readable instructions that may be used to facilitate environmental control. The example processes of FIG. 18 may be performed using a processor, a controller and/or any other suitable processing device. For example, the example processes of FIG. 18 may be implemented using coded instructions (e.g., computer readable instructions) stored on a tangible computer readable medium such as a flash memory, a read-only memory (ROM), and/or a random-access memory (RAM). As used herein, the term tangible computer readable medium is expressly defined to include any type of computer readable storage and to exclude propagating signals. Additionally or alternatively, the example processes of FIG. 18 may be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Alternatively, some or all of the example processes of FIG. 18 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example processes of FIG. 18 may be implemented manually or as any combination(s) of any of the foregoing techniques, for example, any combination of firmware, software, discrete logic and/or hardware. Further, although the example processes of FIG. 18 are described with reference to the flow diagram of FIG. 18, other methods of implementing the processes of FIG. 18 may be employed. For example, the order of execution of the blocks may be changed, and/or some of the blocks described may be changed, eliminated, sub-divided, or combined. Additionally, any or all of the example processes of FIG. 18 may be performed sequentially and/or in parallel by, for example, separate processing threads, processors, devices, discrete logic, circuits, etc.

A game playing process in accordance with an embodiment will now be summarised with reference to the flow diagram of FIG. 18.

At block 500, symbol selection takes place during play of the base game. At block 501, a base game outcome is determined. If a WIN 502, the win is paid and the process then moves on to block 504. If a LOSS 503, the process moves on to block 504 also.

At block 504, a determination is made as to whether or not a characteristic selection game for a feature game is triggered. If NO, the process returns to block 500 and the user has the choice of continuing to play the base game. If YES, then the characteristic selection game is played at block 505. Feature symbols are selected and reels spun as discussed in the above description. In block 506 a determination is made as to whether any game play characteristics for a feature game are selected. If NO, then no feature game is played and the user is returned to block 500 and may continue to play the base game. Note that it is an option in some embodiments that no game play characteristics would be selected at this point, and no feature game played. If YES, then a feature game is played with the selected game play characteristics, at block 507.

At block 508, outcomes of feature games are determined and paid. The process is then returned to the base game at block 500.

In the above embodiment, special feature symbols are used in the characteristic selection game to determine selection of the game play characteristics for the feature game. The invention is not limited to using special feature symbols. Any symbols could be used in the characteristic selection game. For example, conventional card symbols, or fruit symbols, or any other symbols could be used.

In the above embodiment, there is a first and second display, the second display being formed as a frame about the first display. The invention is not limited to this configuration. In a further embodiment, there may only be the first display. Where there is a second display, the second display need not be formed as a framework. It could be placed anywhere on a gaming machine front, for example. In the above embodiment, the second display includes animations (e.g., the animated feature symbols). The invention is not limited to this. The second display need not include animations and may just include stationary graphics, for example.

In the above embodiment, a plurality of game play characteristics may be selected to be played concurrently. There is also an option for one game play characteristic being selected to play only (e.g., the embodiment is not limited to two or more game play characteristics being selected).

In the above described embodiments, the base game (and other feature game) are emulated as reels or implemented as actual reels. In an alternative embodiment, the display may not emulate reels but merely show the selected symbols in a non-reel format (e.g., presenting them as emulated playing cards, or other graphical representations). In such an embodiment, each selection of a set of symbols is equivalent to one "spin" of the reels. The term "reel game", as used in this specification, encompasses such an implementation.

In the above described embodiment, the characteristic selection game and feature games are generated as a feature of a base game. In alternative embodiments, the characteristic selection game and feature game may stand alone and may not be associated with any base game.

In the above described embodiment, there are three levels of gaming. The base game provides a first level of gaming, this triggers a second level of gaming (if the trigger occurs) being the characteristic selection game. An outcome of the characteristic selection game is a third level of gaming. Multiple levels of gaming are thus provided for the entertainment and interest of the player. In an embodiment, all levels are played as reel games. The invention is not limited to playing all levels as reel games, however. Further, in the above embodiment, the third level of gaming is capable of playing with two or more selectable game play characteristics playing concurrently. In another aspect, this third level of gaming may be capable of only playing with one selectable game play characteristic at a time.

In the above embodiment, the feature games are reel-type games. The invention is not limited to the feature games being reel-type games. In embodiments, feature game play may be totally different to the base game. For example, feature games may be played where the player makes selections in a "pick a box type" game. The feature game(s) may be "BINGO" game(s). Other types of feature games are also possible.

It will be appreciated that at least part of the method and gaming system of embodiments of the present may be implemented digitally by a processor. Persons skilled in the art will also appreciate that embodiments may be implemented utilising program code. The program code could be supplied in a number of ways, for example on a tangible computer readable storage medium, such as a disc or a memory (for example, that could replace part of memory 103) or as a data signal (for example, by transmitting it from a server). Persons skilled in the art, will appreciate that program code provides a series of instructions executable by a processor.

In the claims which follow and in the preceding description of certain embodiments of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art is referred to herein, such reference does not constitute an admission that the prior art forms a part of the common general knowledge of the art in any country.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming system comprising:

at least one credit input mechanism comprising at least one of a coin input chute, a bill collector, a card reader, and a ticket reader, the at least one credit input mechanism configured to receive an amount of credit from a player;

a first display configured to display one or more rows and one or more columns arranged in a reel-type format for use in a base game, a characteristic selection game, and a subsequent feature game;

a second display associated with the first display, wherein the second display is configured to display a plurality of feature symbols; and a game controller configured to:

initiate game play of the base game in response to receipt of the amount of credit at the at least one credit input mechanism;

control operation of the characteristic selection game, wherein a plurality of the feature symbols are selected to appear in the one or more rows and the one or more columns, wherein the plurality of the feature symbols are used to determine a plurality of game play characteristics to be played in the subsequent feature game, wherein a threshold number of a single feature symbol of the plurality of feature symbols appearing in a row of the one or more rows with the same single feature symbol displayed in a location on the second display associated with that row determines a game play characteristic associated with that feature symbol to be played in the subsequent feature game, wherein the threshold number is greater than one, and wherein each of the plurality of game play characteristics comprises a game rule that affects a subsequent feature game outcome; and control operation of the subsequent feature game, wherein the subsequent feature game appears in the one or more rows and the one or more columns, wherein the subsequent feature game outcome is affected by each of the plurality of game play characteristics.

2. A gaming system in accordance with claim 1, wherein the second display is arranged as a frame about the first display.

3. A gaming system in accordance with claim 1, wherein the first display comprises a plurality of rows and columns arranged in the reel-type format.

4. A gaming system in accordance with claim 3, wherein the first display has an aspect ratio comprising a greater number of rows than columns.

5. A gaming system in accordance with claim 4, wherein the first display comprises four columns and six rows.

6. A gaming system in accordance with claim 1, wherein the game controller is configured to control operation of a base game, wherein the subsequent feature game is generated as an outcome of the base game.

7. A gaming system in accordance with claim 6, wherein the first display has an aspect ratio comprising a greater number of rows than columns and, wherein the game controller is configured to control operation of the base game to select symbols, from a predetermined set of symbols, to appear on the first display, and to determine a game outcome based on the selected symbols.

8. A gaming system in accordance with claim 6, wherein the game controller is configured to implement a trigger in order to trigger the characteristic selection game, during or after play of the base game.

9. A gaming system in accordance with claim 8, wherein triggering is based on matching a randomly generated number to one or more predetermined numbers.

10. A gaming system in accordance with claim 1, wherein the game controller is configured to control operation of the subsequent feature game by randomly selecting and displaying a plurality of symbols from a predetermined set of symbols, and to determine the subsequent feature game outcomes based on the selected symbols.

11. A gaming system in accordance with claim 10, wherein the selected symbols for the subsequent feature game are displayed on the first display.

12. A gaming system in accordance with claim 10, wherein the subsequent feature game comprises a series of sequential feature games, each feature game comprising selection and display of a plurality of symbols from a predetermined set of symbols and determination of a feature game outcome based on the selected symbols.

13. A gaming system in accordance with claim 12, wherein the game play characteristic includes at least one of the following:

Sticky wild,
Bonus prize,
Collect wild,
Drag and drop multiplier,
All wins multiplier, and
Diminishing royals.

14. A gaming system in accordance with claim 1, wherein the threshold number is equal to a number of columns in the first display.

15. A method of conducting a characteristic selection game, at a gaming machine including a credit input mechanism, the credit input mechanism including at least one of a coin input chute, a bill collector, a card reader, and a ticket reader, the credit input mechanism configured to receive an amount of credit from a player, the method; comprising:

randomly selecting, by a game controller, a plurality of feature symbols from a predetermined set of feature symbols corresponding to respective game play characteristics;

displaying one or more rows and one or more columns arranged in a reel-type format on a first display for use in a base game, the characteristic selection game, and a subsequent feature game;

initiate game play of the base game in response to receipt of the amount of credit at the at least one credit input mechanism;

displaying the predetermined set of feature symbols on a second display associated with the first display;

displaying, by the game controller on the first display, the characteristic selection game, wherein the plurality of feature symbols are displayed in the one or more rows and the one or more columns, wherein the plurality of the feature symbols are used to determine a plurality of game play characteristics to be played in a subsequent feature game, wherein a threshold number of a single feature symbol from the predetermined set of feature symbols appearing in a row of the one or more rows with the same single feature symbol displayed in a location on the second display associated with that row determines a game play characteristic associated with that feature symbol to be played in the subsequent feature game, wherein the threshold number is greater than one, and wherein each of the plurality of game play characteristics comprises a game rule that affects the subsequent feature game outcome; and controlling operation of the subsequent feature game, wherein the subsequent feature game appears in the one or more rows and the one or more columns, wherein the subsequent feature game outcome is affected by each of the plurality of game play characteristics.

16. A method in accordance with claim 15, wherein the second display is arranged as a frame about the first display.

17. A method in accordance with claim 15, wherein the first display comprises a plurality of rows and columns arranged in a reel-type format.

18. A method in accordance with claim 17, wherein the first display has an aspect ratio comprising a greater number of rows than columns.

19. A method in accordance with claim 18, wherein the first display comprises four columns and six rows.

20. A method in accordance with claim 19, further comprising controlling operation of the subsequent feature game by randomly selecting and displaying a plurality of symbols from a predetermined set of symbols, and determining the subsequent feature game outcomes based on the selected symbols.

21. A method in accordance with claim 20, wherein displaying the selected symbols comprises displaying the selected symbols on the first display.

22. A method in accordance with claim 20, wherein the subsequent feature game comprises: playing a series of sequential feature games, each feature game comprising a selection and display of plurality of symbols from a predetermined set of symbols, and determining a game outcome based on the selected symbols.

23. A method in accordance with claim 15, wherein the subsequent feature game is generated as an output of the base game, the method further comprising controlling operation of the base game using the game controller.

24. A method in accordance with claim 23, wherein controlling operation of the base game comprises: selecting symbols from a predetermined set of symbols, displaying the symbols on the first display, and determining a base game outcome based on the selected symbols.

25. A method in accordance with claim 23, further comprising implementing a trigger in order to trigger the characteristic selection game, during or after play of the base game.

26. A method in accordance with claim 25, wherein implementing the trigger comprises: randomly generating a number, matching the randomly generated number with one or more predetermined numbers, and when there is a match, implementing the trigger.

27. A method in accordance with claim 15, wherein each of the plurality of the game play characteristics includes one or more of the following:

Sticky wild,
Bonus prize,
Collect wild,
Drag and drop multiplier,
All wins multiplier, and
Diminishing royals.

28. A non-transitory computer readable medium configured to store a computer program including instructions to control a computer, the instructions, when executed by a game controller of a gaming system, cause the game controller to:

randomly select a plurality of feature symbols from a predetermined set of feature symbols corresponding to respective game play characteristics;

cause a first display to display one or more rows and one or more columns arranged in a reel-type format for use in a base game, a characteristic selection game, and a subsequent feature game;

initiate game play of the base game in response to receipt of an amount of credit at at least one credit input mechanism of the gaming system, the at least one credit input mechanism including at least one of a coin input chute, a bill collector, a card reader, and a ticket reader, the at least one credit input mechanism configured to receive the amount of credit from a player;

cause a second display, associated with the first display, to display the predetermined set of feature symbols;

cause the display of the characteristic selection game, wherein the plurality of the feature symbols are displayed in the one or more rows and the one or more columns, wherein the plurality of the feature symbols are used to determine a plurality of game play characteristics to be played in the subsequent feature game, wherein a threshold number of a single feature symbol from the predetermined set of feature symbols appearing in a single row of the one or more rows with the same single feature symbol displayed in a location on the second display associated with that row determines a game play characteristic associated with that feature symbol to be played in the subsequent feature game, wherein the threshold number is greater than one, and wherein each of the plurality of game play characteristics comprises a game rule that affects the subsequent feature game outcome; and control operation of the subsequent feature game, wherein the subsequent feature game appears in the one or more rows and the one or more columns, wherein the subsequent feature game outcome is affected by the at least one game play characteristics.

29. A method of gaming at a gaming machine including a credit input mechanism, the credit input mechanism including at least one of a coin input chute, a bill collector, a card reader, and a ticket reader, the credit input mechanism configured to receive an amount of credit from a player, the method comprising:

displaying in a first display one or more rows and one or more columns arranged in a reel-type format for use in a base game, a characteristic selection game, and a subsequent feature game;

playing the base game in the first display in response to receipt of the amount of credit at the credit input mechanism, the base game having a plurality of available game outcomes;

playing the characteristic selection game in the first display for selecting game play characteristics to be played in the subsequent feature game, the game play characteristic selection game including:

randomly selecting, by a game controller, a plurality of feature symbols from a predetermined set of feature symbols corresponding to respective game play characteristics, each of the respective game play characteristics comprising a game rule playable in the subsequent feature game;

displaying the plurality of feature symbols on the first display;

displaying the predetermined set of feature symbols on a second display associated with the first display; and selecting, by the game controller, a game play characteristic to be played in the subsequent feature game based on the random selection and display of the plurality of feature symbols, wherein a threshold number of a single feature symbol from the predetermined set of feature symbols being displayed in a row of the one or more rows with the same single feature symbol displayed in a location on the second display associated with that row determines a game play characteristic associated with that feature symbol to be played in the subsequent feature game, wherein the threshold number is greater than one; and playing the subsequent feature game in the first display using the selected game play characteristic.

30. A method in accordance with claim 29, wherein displaying the symbols via a reel-type display comprises using the same display for each of the base game, game play characteristic selection game, and the subsequent feature game.

31. A non-transitory computer readable medium configured to store a computer program including instructions to control a computer, the instructions, when executed by a game controller of a gaming system, cause the game controller to:

control operation of a base game in a first display in response to receipt of an amount of credit at at least one credit input mechanism of the gaming system, the at least one credit input mechanism including at least one of a coin input chute, a bill collector, a card reader, and a ticket reader, the at least one credit input mechanism configured to receive the amount of credit from a player, the first display including one or more rows and one or more columns arranged in a reel-type format, the base game having a plurality of available game outcomes;

control operation of a game play characteristic selection game in the first display, the game play characteristic selection game having a plurality of available game outcomes resulting in selection of a game play characteristic to be played in a subsequent feature game, and to control operation of the subsequent feature game, the game play characteristic selection game comprising:

randomly selecting, by a game controller, a plurality of feature symbols from a predetermined set of feature symbols corresponding to respective game play characteristics, each of the respective game play characteristics comprising a game rule playable in the subsequent feature game;

displaying the plurality of feature symbols on the first display;

displaying the predetermined set of feature symbols on a second display associated with the first display; and selecting, by the game controller, a game play characteristic to be played in the subsequent feature game based on the random selection and display of the plurality of feature symbols, wherein a threshold number of a single feature symbol from the determined set of feature symbols being displayed in a row of the one or more rows with the same single feature symbol displayed in a location on the second display associated with that row determines a game play characteristic associated with that feature symbol to be played in the subsequent feature game, wherein the threshold number is greater than one.

* * * * *